United States Patent [19]

Schoener et al.

[11] Patent Number: 4,647,347

[45] Date of Patent: Mar. 3, 1987

[54] PROCESS AND SEALANT COMPOSITIONS FOR SEALING ANODIZED ALUMINUM

[75] Inventors: Glenn C. Schoener, Chalfont; Susan V. Hess, Telford; Jayne E. Potcner, Lansdale, all of Pa.

[73] Assignee: Amchen Products, Inc., Ambler, Pa.

[21] Appl. No.: 753,701

[22] Filed: Jul. 12, 1985

Related U.S. Application Data

[63] Continuation-in-part of Ser. No. 641,224, Aug. 16, 1984, abandoned.

[51] Int. Cl.[4] ..... C25D 5/48; C25D 11/20; C23C 22/34; C23C 22/83

[52] U.S. Cl. ..... 204/37.6; 148/6.27

[58] Field of Search ..... 204/37.6; 148/6.27, 148/6.24

[56] References Cited

FOREIGN PATENT DOCUMENTS

| | | |
|---|---|---|
| 3301507 | 1/1983 | Fed. Rep. of Germany . |
| 75-117648 | 4/1975 | Japan . |
| 54-15856 | 6/1979 | Japan . |

*Primary Examiner*—Howard S. Williams

*Attorney, Agent, or Firm*—Ernest G. Szoke; Henry E. Millson, Jr.; Real J. Grandmaison

[57] ABSTRACT

Processes, bath compositions, concentrates for preparing the bath compositions, and a replenisher useful in the sealing of anodized aluminum and anodized aluminum alloys. The bath compositions contain nickel ion, fluoride ion, ammonium ion, and acetate ion.

18 Claims, No Drawings

PROCESS AND SEALANT COMPOSITIONS FOR SEALING ANODIZED ALUMINUM

This is a continuation-in-part of application Ser. No. 641,224 filed on Aug. 16, 1984, now abandoned.

BACKGROUND OF THE INVENTION

1. Field of the Invention

This invention relates to sealant compositions for use on anodized aluminum and aluminum alloys. It particularly relates to liquid sealant compositions which are effective both in sealing and in preventing or reducing the formation of smut which frequently occurs when sealants are applied; to concentrates for preparing the sealant compositions, and to processes for using the sealants.

2. Description of the Prior Art

The films which form an electrically oxidizing (anodizing) aluminum and aluminum alloys have very poor resistance to corrosion. A major cause of this problem is the presence of void spaces in the anodized surface which serve as foci for the onset of corrosion and as areas for the accumulation of dirt. These problems with anodized aluminum (and hereinafter anodized aluminum is meant also to include anodized aluminum alloys) have long been recognized, and many attempts have been made to correct them. The principal approach has been the sealing of these void spaces (also referred to as pores), and numerous methods and sealant compositions for this purpose have been described.

The sealing processes and compositions heretofore or now in use, include hot water rinses, steam sealing, aqueous solutions of metallic salts, and non-aqueous sealants such as solutions of long chain carboxylic acids in non-aqueous solvents. The history, advantages and disadvantages of these sealant methods and compositions are described in Brace and Sheasby. The Technology of Anodizing Aluminum, Chapter 16 (Sealing Anodic Oxide Coatings), Second Edition, 1979, Technicopy Ltd., Stonehouse, Gloucestershire, England.

A major problem which occurs with the use of aqueous sealant compositions or water per se as either steam or hot water, is the formation of an uneven chalky or powdery deposit, commonly referred to as smut, on the surface of the anodized aluminum. The formation of smut is apparently a normal occurrence in the sealing operation, and it has been shown that smut is largely bohmite, a hydrated aluminum. The formation of smut affects the appearance of the treated anodized aluminum, and the smut must frequently be removed before the product is acceptable to the purchaser.

Various methods have been used for the removal of smut. These include hand wiping with an alcoholic lanolin solution or fine pumice powder in water (a time consuming operation), treatment with acid (e.g. nitric acid) which may also result in some destruction of the sealant film, and the inclusion of additives in the aqueous sealant composition which inhibit the formation of smut.

Included among these additives are metal salts such as the acetates of nickel, cobalt, cadmium, chromium, zinc, copper, aluminum and lead as well as the sulfates, fluorides, chlorides, nitrates, oxalates, citrates, tartrates and sulfonates of these metals. The use of these additives is shown in many patents which have been extensively reviewed by Kape, Finishing Industries, 1977, 1, 13–20, 38–43, 49. Probably, the most widely used salt is nickel acetate. Other materials which have been included in aqueous sealant compositions include chromates, molybdates, silicates, phosphates, and phosphonic acid derivatives.

The aqueous compositions containing such ingredients have to be used at high temperatures—close to the boiling point of water, a severe economic disadvantage. For example, German Pat. No. 2,211,553 describes the use of 2-phosphonobutane-1,2,4-tricarboxylic acid but the process must be carried out at a temperature between 90° to 100° C. Japanese Pat. No. 75,117,648 shows the use of nickel fluoride in an aqueous solution which also contains a polar solvent such as water-soluble alcohols, ketones, glycols, and diamines. Although these compositions are claimed to be effective at a temperature range of about 30° to 60° C., it is preferred not to use polar solvents in these aqueous compositions, and the patent indicates that the presence of a polar solvent is necessary for effectiveness. Other polar solvents such as isobutanol are volatile with all the known disadvantages of such volatility. Furthermore, it appears that the compositions disclosed in the Japanese patent do not prevent the formation of smut since the patent mentions the formation of a powder coating and states that sulfonates have to be added to remove the coating, so while the compositions of the patent may be effective as sealants at a lower temperature range, they have not been effective in the prevention of smut formation.

Anoseal 1000, a product of Specialty Chemicals & Services, Inc. is now being marketed as a sealant for anodized aluminum which can be used at lower temperatures—in the range of 160°–170° F. The product does not contain fluoride. Special precautions must be taken both prior to and after the sealing operation to insure a seal of good quality, and despite this the sealed product often has a deposit of smut.

Japanese Patent Application No. Sho-54-15856 relates to a method for sealing the pores of anodically oxidized films of aluminum and aluminum alloys using an organic polar solvent and a metal fluoride. Organic polar solvents present several significant disadvantages, e.g. additional cost, vapor problems leading to toxicity and/or flammability hazards, problems in maintaining proper solution levels, etc.

German Patent Application No. 3,301,507A1 relates to a method for sealing pores of anodized aluminum and aluminum alloy surfaces using an aqueous solution containing fluoride ion and optionally other ions such as nickel ion and ammonium ion.

DESCRIPTION OF THE INVENTION

It is an object of this invention to provide sealant compositions free of polar organic solvents for anodized aluminum and anodized aluminum alloys which will minimize or prevent the formation of smut.

It is another object of this invention to provide a sealant composition for anodized aluminum and aluminum alloys which can be used at temperatures below the boiling point of water.

It is still another object of this invention to provide a process which is simple to carry out and requires few precautions.

Other objects will appear in the description which follows.

An aqueous sealant bath (arbitrarily designated Sealant Bath I) designed for use at a temperature in the range of from about 65° to about 94° C. contains the following ingredients:

| SEALANT BATH I | Broad range, g/L* | Preferred range, g/L* |
|---|---|---|
| Ingredient | | |
| $Ni^{+2}$ | 0.19–1.49 | 0.37–1.12 |
| $F^-$ | 0.01–0.12 | 0.03–0.09 |
| smut retardant | 0.005–0.05 | 0.01–0.04 |
| ammonium ion | 0.08–0.67 | 0.17–0.50 |
| acetate ion | 0.61–4.91 | 1.22–3.69 |
| Optional ingredients | | |
| surfactant | 0.0001–0.0008 | 0.0002–0.0006 |
| $K^+$ | 0.03–0.24 | 0.06–0.18 |
| $SO_4^=$ | 0.03–0.25 | 0.06–0.19 |

*approximate

An aqueous sealant bath (arbitrarily designated Sealant Bath II) designed for use at a tempeature in the range of from about 25° to about 32° C. contains the following ingredients:

| SEALANT BATH II | Broad range, g/L* | Preferred range, g/L* |
|---|---|---|
| Ingredient | | |
| $Ni^{+2}$ | 0.09–2.34 | 0.69–1.73 |
| $F^-$ | 0.08–2.11 | 0.62–1.56 |
| ammonium ion | 0.02–0.57 | 0.17–0.42 |
| acetate ion | 0.23–6.18 | 1.83–4.58 |
| Optional ingredients | | |
| $K^+$ | 0.16–4.34 | 1.28–3.21 |
| $SO_4^=$ | 0.01–0.40 | 0.12–0.30 |
| Aluminum Red GLW dye[1] (Mordant Red 82) | 0.00005–0.0012 | 0.0004–0.0009 |
| Aluminum Violet CLW dye[1] (Mordant Violet 60) | 0.00005–0.0012 | 0.0004–0.0009 |

[1]Products of Sandoz Chemicals Corporation
*approximate

In the above sealant bath compositions, the nickel ion can be provided by use of nickel acetate alone or in combination with any other water-soluble nickel salt. Suitable other water-soluble nickel salts include the sulfate, nitrate, chloride and sulfamate. Preferably a combination of nickel acetate and nickel sulfate is used.

The fluoride ion is preferably provided by use of an alkali metal fluoride such as sodium or potassium fluoride, sodium bifluoride, or ammonium bifluoride for Sealant Bath I. The fluorides that can be used for Sealant Bath II can be the above salts except that sodium fluoride cannot be used therein.

The smut retardant used as a component of Sealant Bath I can be a phosphonate or any other substance known to be useful in retarding the formation of smut. These include sulfonates, phosphates and the like. The preferred phosphonate is 2-phosphonobutane-1,2,4-tricarboxylic acid and is used in the form of a 45–50% by weight aqueous solution marketed under the name Bayhibit AM.

Useful surfactants that can be employed as an optional component of Sealant Bath I, which serve as wetting agents to enhance rinsing, include polyethoxylated amines such as the ethoxy-polyoxyethyl-coco amine, tallow amine, hydrogenated tallow amine, oleylamine, soya amine, and the like. A preferred surfactant is a polyethoxylated (12) coco amine (Chemeen C 12G).

The ammonium ion present in the above sealant baths is obtained from ammonium acetate, and, if used as the source of fluoride ion, from ammonium bifluoride.

The acetate ion present in the above sealant baths is obtained from ammonium acetate and nickel acetate.

The optional potassium ion is obtained from potassium fluoride.

The optional sulfate ion is obtained from nickel sulfate, when this salt is selected in combination with nickel acetate as the source of nickel ion.

The Aluminum Red and Aluminum Violet dyes that can optionally be added to Sealant Bath II serve to partially mask the green color which may occur on clear anodized aluminum when Sealant Bath II is applied thereto.

For Sealant Bath I, the pH is from about 4.5 to about 6.5, with from about 5.0 to about 6.0 being preferred, and a pH of about 5.6 being most preferred. Bath adjustment is carried out using either acetic acid or aqueous ammonia, depending on whether the bath is to be made more acid or more alkaline. For this bath, the weight ratio of $Ni^{+2}$ to $F^-$ in the bath must be in the range of from about 0.12:1 to about 14.0:1, preferably in the range of from about 12.0:1 to about 14.0:1. Variations from the broad range generally lead to poor performance results.

For both of the above sealant baths, and in concentrates and replenishers used in their preparation or maintenance, which will be discussed hereinafter, it is preferred to use distilled or deionized water to avoid any interference from undesirable ions (e.g. calcium) which may be present in ordinary tap water.

Sealant Bath I is operated by contacting the anodized aluminum metal substrate to be sealed with the bath solution, preferably by immersion, at a temperature of from about 65° to about 94° C., preferably from about 71° to about 88° C. for a period of from about 1 to about 20 minutes, preferably from about 3 to about 15 minutes, depending on the film thickness of the anodized coating.

Sealant Bath I is preferably made up by adding a concentrated aqueous solution of the ingredients used therein to sufficient water to result in the desired concentration of ingredients in the bath. Concentrates useful herein are those having a nickel ion concentration of more than 5 g/L and preferably above 10 g/L, e.g. at least about 35 g/L, wherein the parts by weight of the ingredients are in the same ratios as those present in the sealant baths, i.e. the concentrates contain the following:

| Concentrate for Sealant Bath I | Broad range, parts by weight* | Preferred range, parts by weight* |
|---|---|---|
| Ingredient | | |
| $Ni^{+2}$ | 0.19–1.49 | 0.37–1.12 |
| $F^-$ | 0.01–0.12 | 0.03–0.09 |
| smut retardant | 0.005–0.05 | 0.01–0.04 |
| ammonium ion | 0.08–0.67 | 0.17–0.50 |
| acetate ion | 0.61–4.91 | 1.22–3.69 |
| Optional ingredient | | |
| surfactant | 0.0001–0.0008 | 0.0002–0.0006 |
| $K^+$ | 0.03–0.24 | 0.06–0.18 |
| $SO_4^=$ | 0.03–0.25 | 0.06–0.19 |

*approximate

In order to replenish the ingredients in the bath as the sealant bath is operated, since the fluoride ion is consumed at a different rate than the nickel ion, the replenisher should have approximately the following relative parts by weight of ingredients:

| Replenisher for Sealant Bath I | Parts by weight |
|---|---|
| Ingredient | |
| $Ni^{+2}$ | 18.6 |
| $F^-$ | 16.8 |
| smut retardant | 0.5 |
| ammonium ion | 23.3 |
| acetate ion | 84.1 |
| Optional ingredients | |
| surfactant | 0.02 |
| $K^+$ | 34.6 |
| $SO_4^=$ | 3.2 |

Sealant Bath II is operated by contacting the anodized aluminum metal substrate to be sealed with the bath solution, preferably by immersion, at a temperature of from about 25° to about 32° C. for a period of from about 3 to about 15 minutes, preferably from about 5 to about 10 minutes.

Sealant Bath II has a bath pH of from about 5.5 to about 8.7, preferably from about 6.2 to about 8.0, and is adjusted as necessary using acetic acid or aqueous ammonia.

Sealant Bath II is also preferably made up by adding a concentrated aqueous solution of the ingredients used therein to sufficient water to result in the desired concentration of ingredients in the bath. Concentrates useful herein are those having a nickel ion concentration of more than 5 g/L and preferably above 10 g/L, i.e. having at least about 35 g/L, wherein the parts by weight of the ingredients are in the same ratios as those present in the sealant bath, i.e. the concentrates contain the following:

| Concentrate for Sealant Bath II | Broad range, parts by weight* | Preferred range, parts by weight* |
|---|---|---|
| Ingredient | | |
| $Ni^{+2}$ | 0.09–2.34 | 0.69–1.73 |
| $F^-$ | 0.08–2.11 | 0.62–1.56 |
| ammonium ion | 0.02–0.57 | 0.17–0.42 |
| acetate ion | 0.23–6.18 | 1.83–4.58 |
| Optional ingredients | | |
| $K^+$ | 0.16–4.34 | 1.28–3.21 |
| $SO_4^=$ | 0.01–0.40 | 0.12–0.30 |
| Aluminum Red GLW dye[1] | 0.00005 –0.0012 | 0.0004–0.0009 |
| Aluminum Violet CLW dye[1] | 0.00005 –0.0012 | 0.0004–0.0009 |

[1]Products of Sandoz Chemicals Corporation
*approximate

In order to replenish Sealant Bath II, the above concentrate can be employed; a separate replenisher composition not being required here.

The invention will become clearer from the examples which follow. These examples are given by way of illustration and are not to be considered as limiting.

EXAMPLE 1

A concentrate was prepared by dissolving the following amounts in grams in the indicated amount of water:

| | |
|---|---|
| nickel acetate.$4H_2O$ | 144.09 |
| nickel sulfate.$6H_2O$ | 17.71 |
| Bayhibit AM | 3.28 |
| Chemeen C 12G | 0.11 |
| potassium fluoride | 8.96 |
| ammonium acetate (65%) | 109.30 |
| deionized water q.s. | 1 liter |

This concentrate contained in g/liter:

| | |
|---|---|
| nickel | 38.1 |
| fluoride | 2.93 |
| ammonium acetate | 71.1 |
| 2-phosphono-butane 1,2,3-tricarboxylic acid | 1.49 |
| polyoxyethylene (12) coco amine | 0.022 |

EXAMPLE 2

A composition similar to Example 1 was prepared except that 161.5 g of nickel acetate.$4H_2O$ was used and the nickel sulfate.$6H_2O$ was omitted.

EXAMPLES 3–7

Following the procedure of Example 1 concentrates of the following compositions were prepared:

| Material | 3 | 4 | 5 | 6 | 7 |
|---|---|---|---|---|---|
| nickel acetate.$4H_2O$ | 160 | 150 | 150 | 150 | 140 |
| nickel sulfate.$6H_2O$ | 12 | 10 | 20 | 25 | 30 |
| ammonium acetate (65%) | 120 | 120 | 105 | 110 | 110 |
| Bayhibit AM | 3.20 | 3.40 | 3.40 | 3.10 | 3.30 |
| Chemeen C12G | 0.10 | 0.15 | 0.15 | 0.12 | 0.12 |
| deionized water q.s. | 1 L. | 1 L. | 1 L. | 1 L. | 1 L. |

The amounts in these examples, except for the water, are in grams.

In applying a seal according to this invention, the sealant bath containing the desired composition was heated to a temperature of from about 140° to about 190° F. and the anodized aluminum product was immersed in the bath for a period of from about 1 to about 15 minutes. It was then removed and no further treatment was necessary. Generally, it is preferred to use a temperature of about 170° F. and an immersion time of about 10 minutes. These conditions have been demonstrated to effect a good seal without the concomitant formation of smut on a film of anodized aluminum having a thickness of about 20μ. The compositions now available or disclosed in the literature are not able to effect a good seal without the formation of smut under these conditions.

EXAMPLE 8

A sealant bath was prepared by adding the concentrate of Example 1 to deionized water to provide a 1.5% v/v concentration of the concentrate in the bath. The bath so prepared contained in g/L:

| | |
|---|---|
| nickel | 0.56 |
| fluoride | 0.04 |
| 2-phosphono-butane-1,2,4-tricarboxylic acid | 0.02 |
| polyoxyethylene (12)-coco amine | 0.00033 |
| ammonium acetate | 1.06 |

The nickel to fluoride ratio in the bath was 14.0:1 and the pH was 5.6.

The bath was heated to a temperature of about 170° C. and a 3"×4" extruded anodized aluminum panel (6063 alloy) was immersed therein for about 10 minutes. It was then removed and dried. Examination of the dried product showed a very good seal and no signs of smut.

EXAMPLE 9

The procedure of Example 8 was repeated except that the anodized aluminum product was rinsed with water at a temperature of about 120° F. after removal from the bath. There were no differences between the products of Example 8 and of this example.

EXAMPLE 10

The procedure of Example 8 was repeated using the concentrate of Example 2.

EXAMPLE 11

The procedure of Example 8 was repeated using the concentrate of Example 3.

EXAMPLE 12

The procedure of Example 8 was repeated using an immersion time of 15 minutes.

EXAMPLE 13

The procedure of Example 8 was repeated using a temperature of 190° F.

EXAMPLE 14

The procedure of Example 13 was repeated using an immersion time of 3 minutes.

EXAMPLE 15

The procedure of Example 8 was repeated using a 3% v/v concentration of the concentrate and an immersion time of 5 minutes.

EXAMPLE 16

The procedure of Example 8 was repeated using an immersion time of 10 minutes and a temperature of 140° F.

EXAMPLE 17

The procedure of Example 8 was repeated using an immersion time of 15 minutes and a 1% v/v concentration of the concentrate.

EXAMPLE 18

The procedure of Example 8 was repeated using a 2% v/v concentration and an immersion time of 5 minutes.

The products of Examples 10 to 18 possessed a good seal and showed no smut.

As the above baths were used, the materials contained therein was consumed and after repeated use it became necessary either to prepare a new bath or to replenish the materials therein. For the sake of convenience, replenishment is preferred. Since the fluoride in the bath is consumed at a faster rate than the nickel, it has been found necessary to have more fluoride than nickel in the replenishing concentrate. A suitable concentrate for replenishing the bath contains in g/L:

| | |
|---|---|
| nickel | 18.6 |
| fluoride | 16.8 |
| 2-phosphono-butane-1,2,4-tricarboxylic acid | 0.5 |
| polyoxyethylene (12) coco amine | 0.02 |
| ammonium acetate | 65.0 |

The replenishment concentrate was added to the bath from time to time in amounts necessary to maintain the concentration of the bath ingredients. Bath composition was determined by periodic titration of the nickel ion content of the bath.

Example 19 illustrates the preparation of a suitable replenishing concentrate having the composition described above.

EXAMPLE 19

The following ingredients (amounts in grams) were dissolved in sufficient water to provide a liter of the solution.

| | |
|---|---|
| nickel acetate.$4H_2O$ | 72.65 |
| nickel sulfate.$6H_2O$ | 8.90 |
| Bayhibit AM | 1.00 |
| Chemeen C 12G | 0.02 |
| potassium fluoride | 51.52 |
| ammonium acetate (65%) | 100.00 |
| deionized water q.s. | 1 L. |

EXAMPLE 20

A concentrate was prepared by dissolving the following ingredients in deionized water.

| Ingredient | Concentration, g/L |
|---|---|
| nickel acetate .$4H_2O$ | 72.51 |
| nickel sulfate .$6H_2O$ | 8.85 |
| Potassium fluoride | 51.43 |
| Ammonium acetate (65%) | 99.81 |

The above concentrate contains the following quantities of ions:

| | |
|---|---|
| $Ni^{+2}$ | 18.64 g/L |
| $F^-$ | 16.82 g/L |
| $SO_4^{-2}$ | 3.23 g/L |
| $K^+$ | 34.61 g/L |
| $NH_4^+$ | 15.17 g/L |
| acetate ion | 84.11 g/L |

EXAMPLE 21

A sealant bath was prepared by adding 40 g/l of the concentrate of Example 20 to deionized water. The bath so prepared contained in g/L:

| | |
|---|---|
| $Ni^{+2}$ | 0.68 |
| $F^-$ | 0.62 |
| $NH_4^+$ | 0.55 |
| acetate ion | 3.08 |
| $SO_4^=$ | 0.12 |
| $K^+$ | 1.27 |

The bath was heated to 30° C. and the pH adjusted to 8.0 using aqueous ammonia. Anodized aluminum parts (2"×5" panels) were immersed in the bath for 10 minutes. The parts were rinsed in tap water and allowed to air dry. Upon examination they were completely free of smut and passed all standard quality tests after aging for 18 hours.

EXAMPLE 22

A concentrate was prepared by dissolving the following ingredients in deionized water.

| Ingredient | Concentration, g/L |
|---|---|
| nickel acetate .4$H_2O$ | 72.51 |
| nickel sulfate.6$H_2O$ | 8.95 |
| Potassium fluoride | 51.43 |
| Ammonium acetate (65%) | 30.00 |
| Aluminum Red GLW | 0.0155 |
| Aluminum Violet CLW | 0.0155 |

The above concentrate contains the following quantities of ions:

| | |
|---|---|
| $Ni^{+2}$ | 18.64 g/L |
| $F^-$ | 16.82 g/L |
| $SO_4^{-2}$ | 3.23 g/L |
| $K^+$ | 34.61 g/L |
| $NH_4^+$ | 4.56 g/L |
| acetate ion | 49.31 g/L |

EXAMPLE 23

A sealant bath was prepared by adding 40 g/L of the concentrate of Example 22 to deionized water. The bath so prepared contained in g/L:

| | |
|---|---|
| $Ni^{+2}$ | 0.69 |
| $F^-$ | 0.62 |
| $NH_4^+$ | 0.17 |
| acetate ion | 1.83 |
| $SO_4^=$ | 0.12 |
| $K^+$ | 1.28 |
| Aluminum Red GLW | 0.0004 |
| Aluminum Violet CLW | 0.0004 |

The bath was heated to 30° C. and the pH adjusted to 8.0 using aqueous ammonia. Anodized aluminum parts (2"×5" panels) were immersed in the bath for 10 minutes. The parts were rinsed in tap water and allowed to air dry. Upon examination they were completely free of smut and passed all standard quality tests after aging for 18 hours.

As can be seen from the above examples, the processes of this invention are easy to carry out and require no special precautions to be taken prior to, during or after the operations.

What is claimed is:

1. A non-smut producing aqueous sealant bath free of polar organic solvents and smut retardants for anodized aluminum and alloys thereof comprising, in approximate g/L:

| | |
|---|---|
| $Ni^{+2}$ | 0.09–2.34 |
| $F^-$ | 0.08–2.11 |
| $NH_4^+$ | 0.02–0.57 |
| acetate ion | 0.23–6.18 |

2. An aqueous sealant bath in accordance with claim 1 wherein the ingredients thereof are, in approximate g/L:

| | |
|---|---|
| $Ni^{+2}$ | 0.69–1.73 |
| $F^-$ | 0.62–1.56 |
| $NH_4^+$ | 0.17–0.42 |
| acetate ion | 1.83–4.58 |

3. The composition of claim 2 wherein there is also present at least one of the following:

| | |
|---|---|
| $K^+$ | 1.28–3.21 |
| $SO_4=$ | 0.12–0.30 |

4. An aqueous sealant bath in accordance with claim 1 wherein the nickel ion is present in the form of nickel acetate, either alone or in combination with another water-soluble nickel salt.

5. An aqueous sealant bath in accordance with claim 1 wherein the other water-soluble nickel salt is nickel sulfate.

6. An aqueous sealant bath in accordance with claim 1 wherein the fluoride ion is present as potassium fluoride, sodium bifluoride, or ammonium bifluoride.

7. An aqueous sealant bath in accordance with claim 1 wherein the pH of the bath is in the range of from about 5.5 to about 8.7.

8. An aqueous sealant bath in accordance with claim 1 wherein a small quantity of one or more dyes is present.

9. An aqueous sealant bath in accordance with claim 1 wherein the following dyes are present:

from about 0.00005 to about 0.0012 Aluminum Red GLW, and from about 0.00005 to about 0.0012 Aluminum Violet CLW.

10. An aqueous concentrate for forming and replenishing the sealant bath of claim 18 wherein said concentrate contains at least 5 g/L of nickel ion and contains the following in approximate parts by weight:

| | |
|---|---|
| $Ni^{+2}$ | 0.09–2.34 |
| $F^-$ | 0.08–2.11 |
| ammonium ion | 0.02–0.57 |
| acetate ion | 0.23–6.18 |

11. An aqueous concentrate in accordance with claim 10 which contains in approximate parts by weight:

| | |
|---|---|
| $Ni^{+2}$ | 0.69–1.73 |
| $F^-$ | 0.62–1.56 |
| ammonium ion | 0.17–0.42 |
| acetate ion | 1.83–4.58 |

12. The concentrate composition of claim 11 wherein there is also present at least one of the following:

| | |
|---|---|
| $K^+$ | 1.28–3.21 |
| $SO_4=$ | 0.12–0.30 |

13. The composition of claim 10 wherein there is also present at least one of the following:

| | |
|---|---|
| $K^+$ | 0.16–4.34 |
| $SO_4=$ | 0.01–0.40 |

14. The composition of claim 1 wherein there is also present at least one of the following:

| | |
|---|---|
| $K^+$ | 0.16–4.34 |
| $SO_4^=$ | 0.01–0.40 |

15. A process for sealing anodized aluminum and alloys thereof which comprises immersing an anodized aluminum substrate in the sealant bath of claim 1 for a period of from about 3 to about 15 minutes at a temperature of from about 25° to about 32° C.

16. A process in accordance with claim 15 wherein the period of time is in the range of from about 5 to about 10 minutes.

17. A process in accordance with claim 15 wherein the substrate following immersion is rinsed with water and dried.

18. A process for sealing anodized aluminum and alloys thereof which comprises immersing an anodized aluminum substrate in the sealant bath of claim 19 for a period of from about 3 to about 15 minutes at a temperature of from about 25° to about 32° C.

* * * * *

UNITED STATES PATENT AND TRADEMARK OFFICE

CERTIFICATE OF CORRECTION

PATENT NO. : 4,647,347

DATED : March 3, 1987

INVENTOR(S) : Glenn C. Schoener et al.

It is certified that error appears in the above-identified patent and that said Letters Patent is hereby corrected as shown below:

Column 10, line 37, for "claim 18" read --claim 1--.
Column 12, line 9, for "claim 19" read --claim 2--.

Signed and Sealed this

Third Day of May, 1988

*Attest:*

DONALD J. QUIGG

*Attesting Officer*

*Commissioner of Patents and Trademarks*